US007896161B2

(12) United States Patent
Reilley et al.

(10) Patent No.: US 7,896,161 B2
(45) Date of Patent: Mar. 1, 2011

(54) CHILD-RESISTANT, SENIOR FRIENDLY CARDED PACKAGE AND METHOD OF ASSEMBLY

(75) Inventors: Shawn P. Reilley, Belvidere, IL (US); Curtis Knutson, Loves Park, IL (US); Timothy Powell, Polo, IL (US); Jeff Smoczynski, Delton, MI (US)

(73) Assignee: Anderson Packaging, Inc., Rockford, IL (US)

( * ) Notice: Subject to any disclaimer, the term of this patent is extended or adjusted under 35 U.S.C. 154(b) by 459 days.

(21) Appl. No.: 12/014,239

(22) Filed: Jan. 15, 2008

(65) Prior Publication Data

US 2009/0178949 A1 Jul. 16, 2009

(51) Int. Cl.
*B65D 75/34* (2006.01)
*B65D 83/04* (2006.01)

(52) U.S. Cl. ..... 206/531; 206/532; 206/538; 206/462

(58) Field of Classification Search ..... 206/531, 206/528, 532, 534, 538, 828, 462, 469, 470, 206/461
See application file for complete search history.

(56) References Cited

U.S. PATENT DOCUMENTS 4,125,190 A 11/1978 Davie, Jr. et al.
5,339,960 A 8/1994 Price
5,927,500 A * 7/1999 Godfrey et al. ..... 206/531
5,954,202 A 9/1999 Mellon
6,024,222 A 2/2000 Friberg et al.
6,047,829 A 4/2000 Johnstone et al.
6,161,699 A * 12/2000 Gartland ..... 206/531
6,394,275 B1 5/2002 Paliotta et al.
6,659,280 B2 12/2003 Paliotta et al.
6,675,972 B2 1/2004 Patterson
6,951,282 B2 10/2005 Jones
6,964,338 B2 11/2005 Kancsar et al.
6,974,031 B2 12/2005 Kancsar et al.
7,000,768 B2 2/2006 Morita et al.
7,201,274 B2 4/2007 Paliotta et al.
2004/0108240 A1 6/2004 Ragot
2004/0188311 A1 9/2004 Paliotta et al.

(Continued)

OTHER PUBLICATIONS

European Search Report for corresponding European Patent Application No. 09250098.

*Primary Examiner*—Mickey Yu
*Assistant Examiner*—Steven A. Reynolds
(74) *Attorney, Agent, or Firm*—Howson & Howson LLP

(57) ABSTRACT

A child-resistant and senior-friendly carded package for storing and dispensing tablets and like items is provided. The carded package assembly has a integral pair of opposed flaps. One flap carries the tablets or like items, and the other provides a booklet-style cover foldable between a position covering the tablets or like items and a position exposing the tablets or like items. The carded package is made from a first card bonded to a separate second card with a blister card captured therebetween. The first card has a flap including at least three panels folded together with each of the at least three panels including cut out openings or perforations defining punch outs. The second card has a flap having cut out openings. The blister card is sandwiched between the at least three panel flap of the first card and the flap of the second card having openings. A method of assembling the package is also provided.

12 Claims, 5 Drawing Sheets

U.S. PATENT DOCUMENTS

2006/0289328 A1 12/2006 Hession
2007/0056876 A1 3/2007 Jones
2007/0235368 A1 10/2007 Knutson et al.
2007/0246396 A1 10/2007 Brollier
2008/0110791 A1* 5/2008 Specker ..... 206/531
2009/0107873 A1* 4/2009 Cotton et al. ..... 206/531

* cited by examiner 10
52
16
18
2
3
14
26
56
66
54
74
12
2
3
22
64

10
32
28
26
24
16
52
12
56
18
22
74
40
14
34
38
30
70
72
76
36
20
54

2/5

CHILD-RESISTANT, SENIOR FRIENDLY CARDED PACKAGE AND METHOD OF ASSEMBLY

BACKGROUND OF THE INVENTION

The present invention relates to a package for containing items, such as doses of medicine, that can be dispensed therefrom, and more particularly, the present invention relates to a carded booklet style package that includes a blister card and that has child-resistant, senior-friendly dispensing properties.

Paperboard carded packages including a blister card are disclosed, for example, by U.S. Pat. No. 4,125,190 issued to Davie, Jr. et al., U.S. Pat. No. 5,339,960 issued to Price, U.S. Pat. No. 5,954,202 issued to Mellon, U.S. Pat. No. 6,394,275 B1 and U.S. Pat. No. 6,659,280 B2 issued to Paliotta et al., and U.S. Pat. No. 6,951,282 B2 issued to Jones and by U.S. Patent Application Publication No. 2006/0289328 A1 of Hession. Also see U.S. Pat. No. 6,047,829 issued to Johnstone et al., U.S. Pat. No. 6,024,222 issued to Friberg et al., U.S. Pat. No. 6,675,972 B2 issued to Patterson, U.S. Pat. No. 6,964,338 B2 and U.S. Pat. No. 6,974,031 B2 issued to Kancsar et al., U.S. Pat. No. 7,000,768 B2 issued Morita et al., and U.S. Pat. No. 7,201,274 B2 issued to Paliotta et al. and U.S. Patent Application Publication Nos. 2004/0188311 A1 of Paliotta et al. and 2004/0108240 A1 issued to Ragot.

Although the above referenced carded packages disclosed by the above referenced patents and published applications may be satisfactory for their intended purpose, there is a need for a carded package of novel construction that provides a desired amount of child-resistance, yet from which tablets can be readily dispensed by an intended end-user, such as a senior citizen. Further, there is a needed for a novel and cost efficient method of assembling a carded package.

BRIEF SUMMARY OF THE INVENTION

According to the present invention, a child-resistant carded package for storing and dispensing tablets and like items is provided. The carded package assembly has a integral pair of opposed flaps. One flap carries the tablets or like items, and the other provides a booklet-style cover foldable between a position covering the tablets or like items and a position exposing the tablets or like items.

The carded package assembly is made from a first card bonded to a separate second card with a blister card captured therebetween. The blister card has a plurality of separate upstanding blister compartments in which the tablets or like items are separately contained. The first card has a flap forming part of the booklet-style cover and a flap including at least three panels folded together with each of the at least three panels including cut out openings or perforations defining punch outs. The second card has a flap forming part of the booklet-style cover and a flap having cut out openings. The blister card is sandwiched between the at least three panel flap of the first card and the flap of the second card having openings. In this configuration, the blister compartments project through the openings of the second card, and the cut out openings and punch outs of the first card are located behind the blister compartments and define paths through which the tablets or like items are required to be dispensed from the package.

According to another aspect of the present invention, a method of assembling a child-resistant carded package is provided. The method includes bonding a first card to a separate second card with a blister card captured therebetween to form a carded package assembly having a pair of opposed flaps with one of the flaps supporting the blister card and the other of the flaps being a booklet-style cover foldable between a position concealing the blister compartments of the blister card and a position exposing the blister compartments of the blister card. Before the above referenced bonding step, the first card is provided in blank form, and a part of the blank is folded into a convolute configuration forming a flap at least three panels thick. Thereafter, the at least three panels are secured together. In this condition, the first card includes a flap for forming part of the booklet-style cover and the at least three panel thick flap. Each of the at least three folded panels includes cut out openings or perforations defining punch outs.

BRIEF DESCRIPTION OF THE DRAWINGS

The present invention should become apparent from the following description when taken in conjunction with the accompanying drawings, in which.

DETAILED DESCRIPTION OF THE INVENTION

Figure 1:
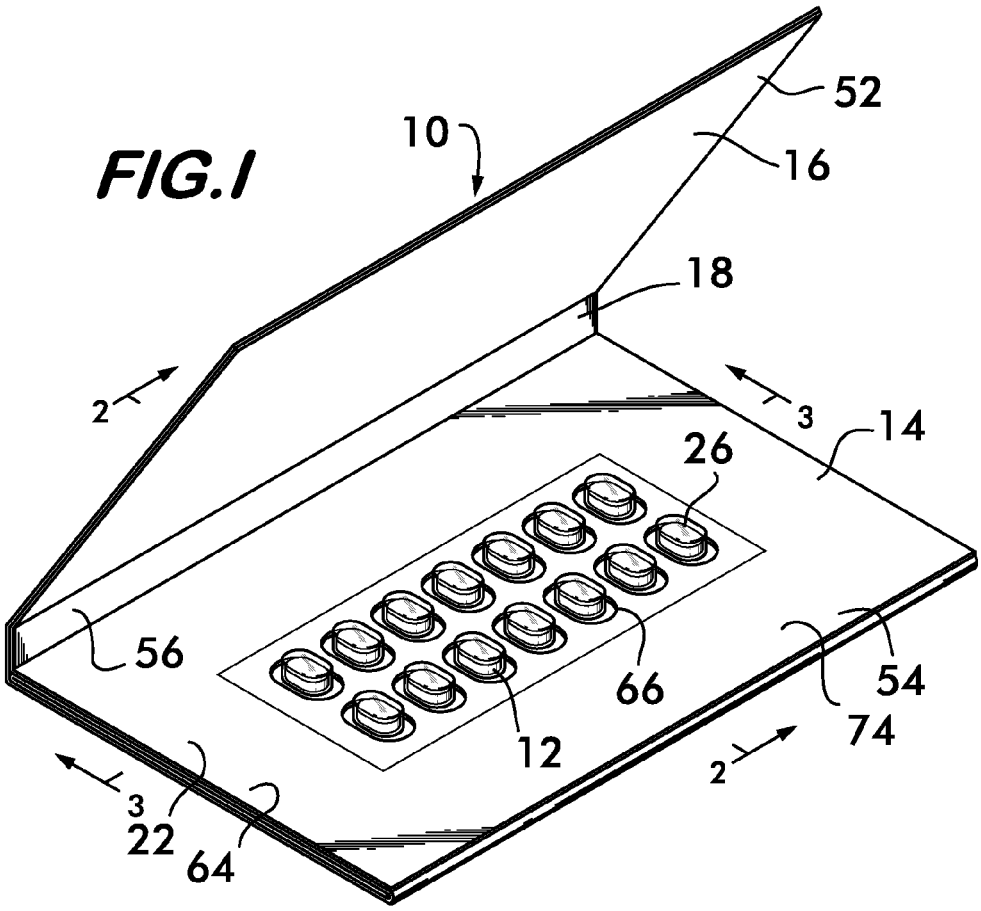
FIG. 1 is perspective view of a carded package assembly according to the present invention.
Figure 8:
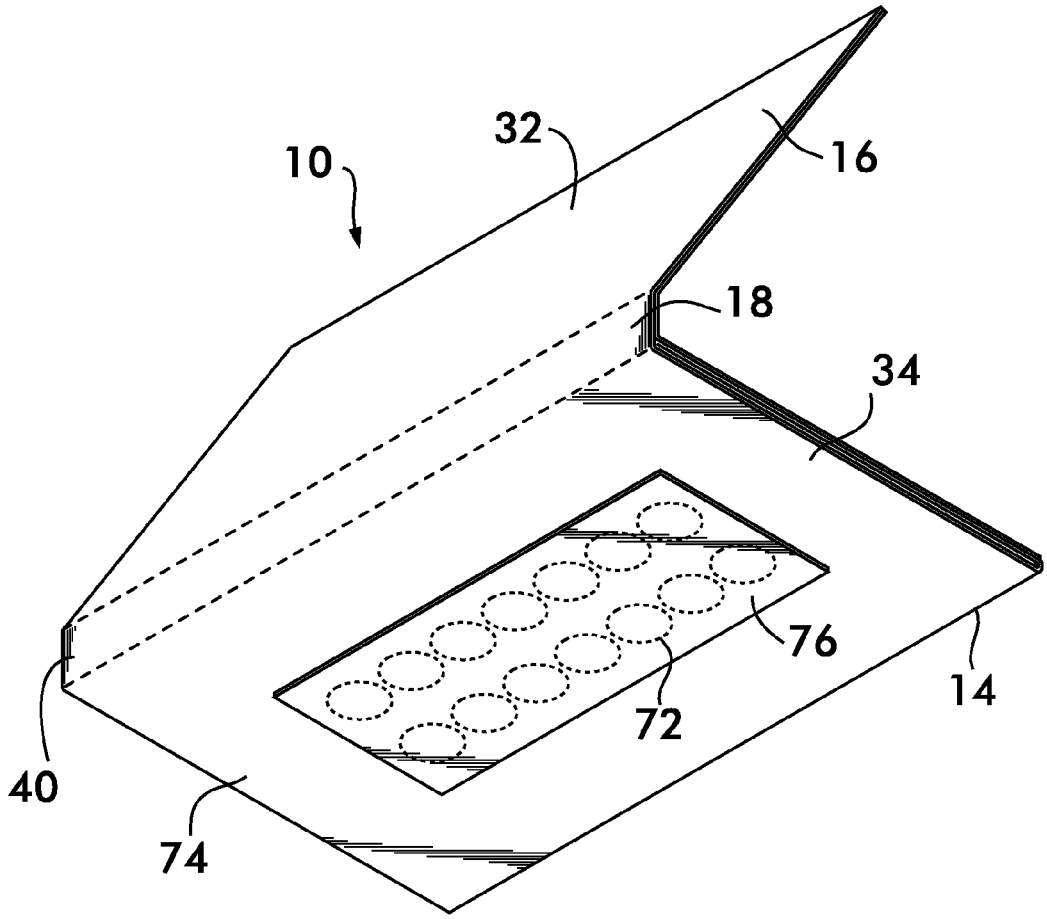
FIG. 8 is a perspective view of an exterior side of the carded package assembly of FIG. 1.

A carded package 10 according to the present invention is illustrated in FIGS. 1 and 8. The package 10 contains tablets 12 and/or like separate items and provides child-resistant, senior-friendly dispensing properties. For example, the tablets 12 can be doses of medicine, vitamins, supplements, or any other product that is provided in tablet or like form.

As best illustrated in FIGS. 1 and 8, the fully assembled carded package 10 has a pair of opposed flaps, 14 and 16, provided in a so-called booklet-style. The flap 14 carries the tablets 12, and the flap 16 provides a booklet-style cover. For example, the flap 16 is foldable about a sidewall, or edge binding, 18 of the package 10 to a position covering the tablets 12 (for instance, see FIG. 2) and to a position exposing the tablets 12 to the end user in the same manner a book cover enables access to the pages of a book. The tablets 12 are neither readily viewable nor dispensable from the package 10 when the package 10 is in the closed position shown in FIG. 2. Various means such as tabs, slots, adhesive strips, hook and loop fasteners, clips, shrink wrap, a sleeve or the like (not shown) can be used to retain the package 10 in the closed position, if desired.

The carded package 10 includes and is assembled from a first card 20, a separate second card 22, and a blister card 24. According to one preferred contemplated embodiment of the present invention, the package 10 is constructed solely of these three components. See FIG. 7.

The blister card 24 carries a plurality of separate items, such as tablets 12, in separate blister compartments 26 so that the items can be dispensed individually, or in sets, from the blister card 24. The blister card 24 can be made of plastic, paperboard, paper, foil or the like. For example, the card 24 can include a transparent plastic layer 28 defining the compartments 26 and a rupturable paper and/or foil backing layer 30 laminated to a rear side of the layer 28 to seal the items in the compartments 26.

The first and second cards, 20 and 22, are each preferably formed of a paperboard material, for example a SBS (solid bleached sulfate) paperboard stock material. Of course, materials other than paperboard and materials within a range of thicknesses can be used. However, preferably the material used for the cards, 20 and 22, should enable the cards to be provided in a relatively flat blank form on which panels, fold lines, openings, and perforations can be readily formed and/or defined. In addition, preferably one side of the blanks of the cards, 20 and 22, should be capable of being coated with a continuous or discontinuous layer of a heat and/or pressure activated adhesive. Further, the opposite side of the blanks of the cards, 20 and 22, should preferably be glossy or otherwise of a desired texture and/or appearance for forming the visible external surfaces of the package 10.

Figure 4:
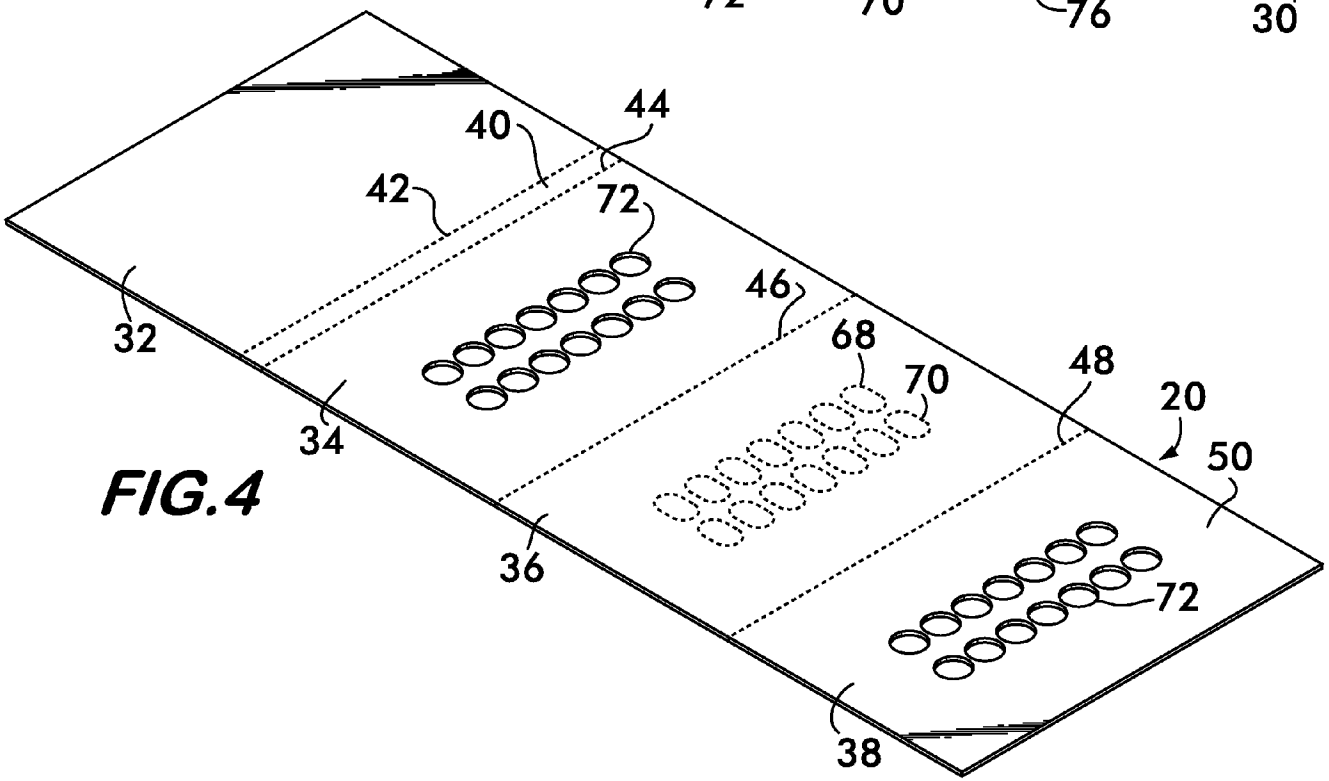
FIG. 4 is a perspective view of a blank of a first card for use in making the assembly of FIG. 1.

As best illustrated in FIG. 4, the first card 20 in black form is relatively elongate and defines four primary panels. The panel 32 ultimately is used to form part of the flap 16 forming the book-style cover of the package 10. The panels 34, 36 and 38 are used to form a rear part of the flap 14 to which the blister card 24 is secured. The blank of the first card 20 also includes a relatively thin panel 40 which forms part of the sidewall, or edge binding, 18 of the booklet-style package 10. Further, fold lines 42, 44, 46 and 48 define the boundaries of the various panels of the first card 20 about which the blank is folded to form and/or use the package 10. The side 50 of the first card 20 shown exposed in FIG. 4 is the side of the card 20 preferably coated with a layer of heat and/or pressure activated adhesive.

Figure 5:
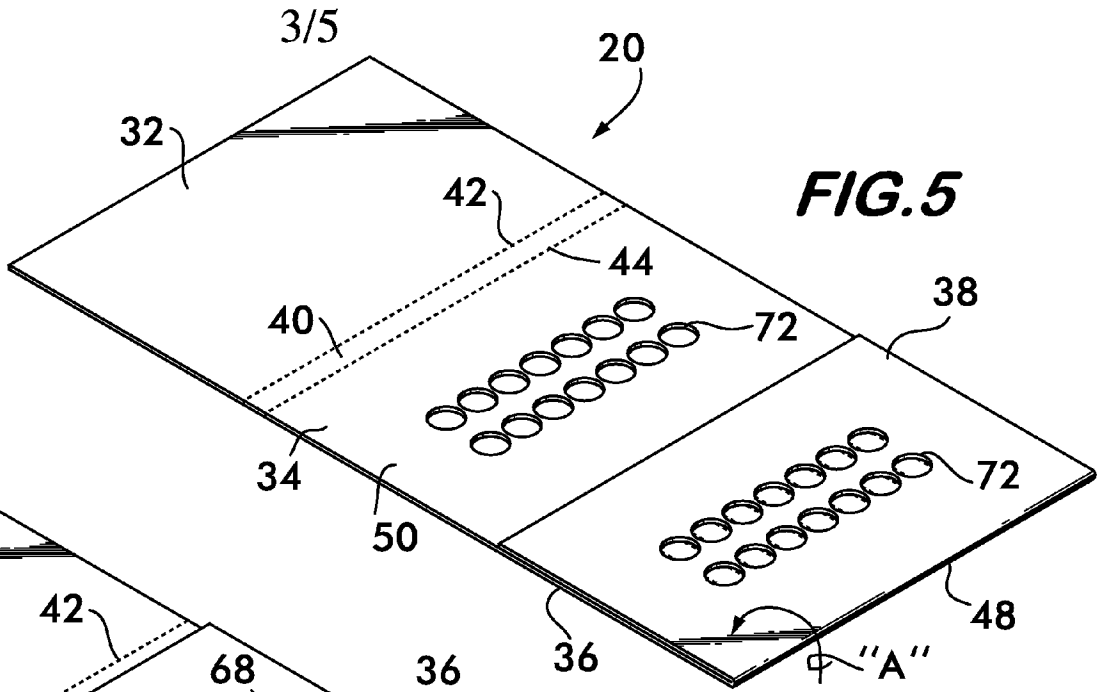
FIG. 5 is a perspective view of the first card of FIG. 4 after a first fold.

As best illustrated in FIG. 5, the blank of the first card 20 is first folded along fold line 48 such that panel 38 confronts and overlies the adjacent panel 36. As shown by arrow "A" in FIG. 5, the panel 38 is preferably folded or pivoted in a counter-clockwise direction in the example illustrated in FIG. 5. In the folded position, the adhesive layer of panel 36 confronts the adhesive layer of panel 38, and these confronting adhesive layers will ultimately be used to bond these two layers together.

Figure 6:
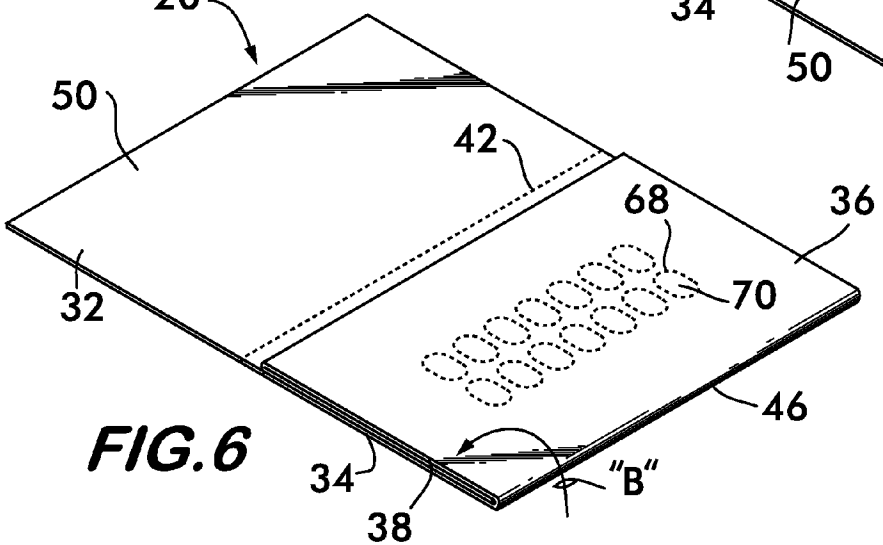
FIG. 6 is a perspective view of the first card of FIG. 4 after a second convolute fold.

After the fold illustrated in FIG. 5 is completed, the blank of the first card 20 is folded along line 46 preferably in a counter-clockwise direction as shown by an arrow "B" illustrated in FIG. 6. For purposes of this application, this is termed "convolute folding" and is in contrast to bellows or accordion style folding. In the convolute fold, the panels extend in a spiral, wound or rolled configuration instead of an alternating bellows type configuration. Accordingly, in the example provided in FIG. 6, the panel 38 confronts and lies directly above the panel 34, and the panel 36 confronts and lies directly above the panel 38. Pressure and/or heat is applied to the three panels, 34, 36 and 38 to bond them together in the convolute-folded condition shown in FIG. 6. The adhesive layer of panel 34 bonds to the non-adhesive glossy side of panel 38, and the confronting adhesive layers of panels 36 and 38 bond panels 36 and 38 together. This thereby leaves the glossy (non-adhesive) sides of the panels 34 and 38 exposed as external surfaces of the folded blank.

The second card 22 in blank form can be provided having a pair of primary panels 52 and 54 connected via a relatively narrow panel 56 which ultimately forms part of the sidewall, or edge binding, 18 of the package 10. Fold lines 58 and 60 define the boundaries of these panels. Preferably, the underside 62 of the second card 22 as illustrated in FIG. 7 is coated with a pressure and/or heat activated adhesive, and the top side 64 is glossy or otherwise provides a desired texture and/or appearance required of the external surfaces of the package 10.

Figure 7:
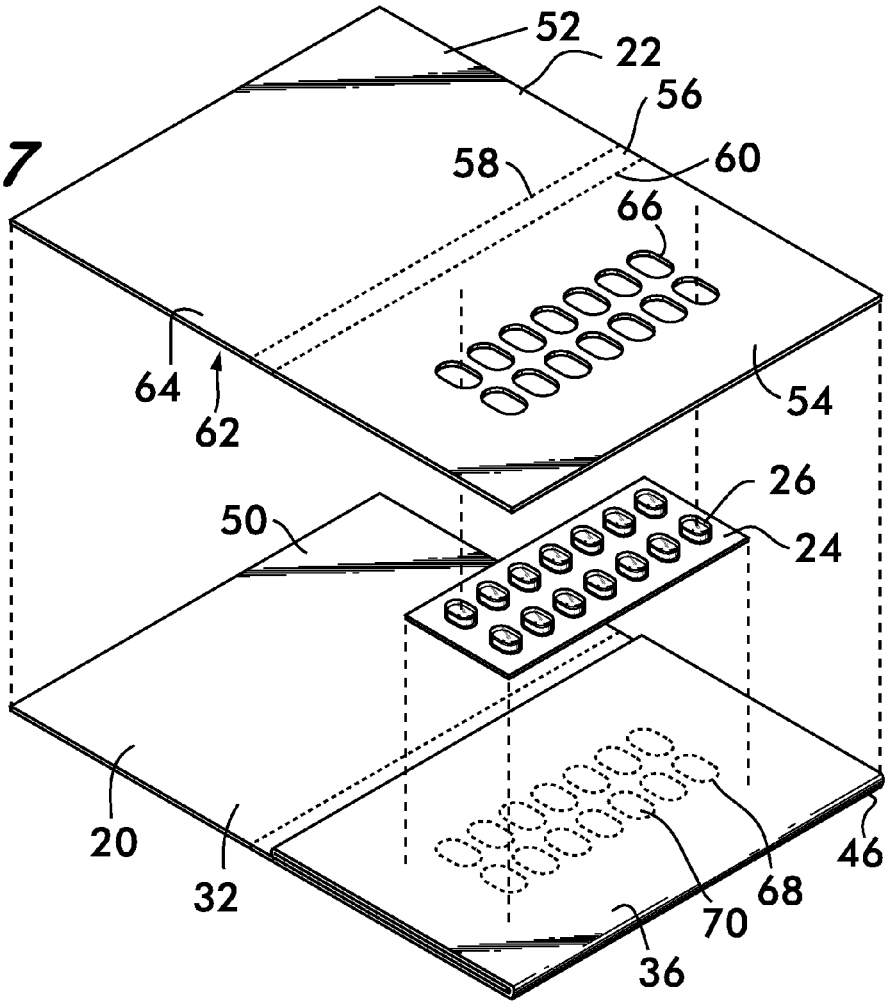
FIG. 7 is an exploded view of the carded package assembly of FIG. 1.

As best illustrated in FIG. 7, the blister card 24 is positioned between the convolute-folded three panel structure of the first card 20 and the panel 54 of the second card 22. The first and second cards, 20 and 22, are brought together and heat and/or pressure is applied to activate the adhesive layer on the underside 62 of the second card and the side 50 of panel 32 of the first card 20. This adhesively bonds panel 52 of the second card 22 to the panel 32 of the first card 20 and the panel 54 of the second card 22 to the panel 36 of the first card 20. In this condition, the blister card 24 is captured between the panel 54 of the second card 22 and the panel 36 of the first card 20. With respect to flap 14, this forms a four layer paperboard panel (not counting any layers of the blister card). The flap 12 forming the booklet-style cover and the sidewall 18 of the package 10 are provided as two layer structures in the illustrated example.

Figure 2:
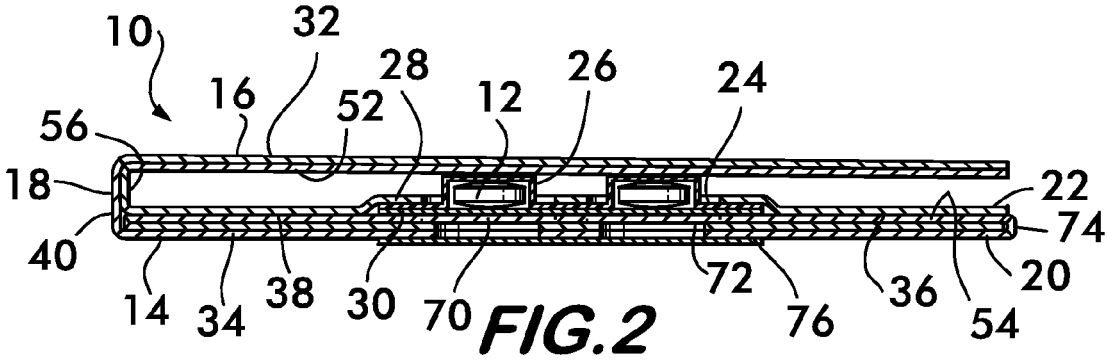
FIG. 2 is a cross-sectional view of the assembly taken along line 2-2 of FIG. 1.
Figure 3:
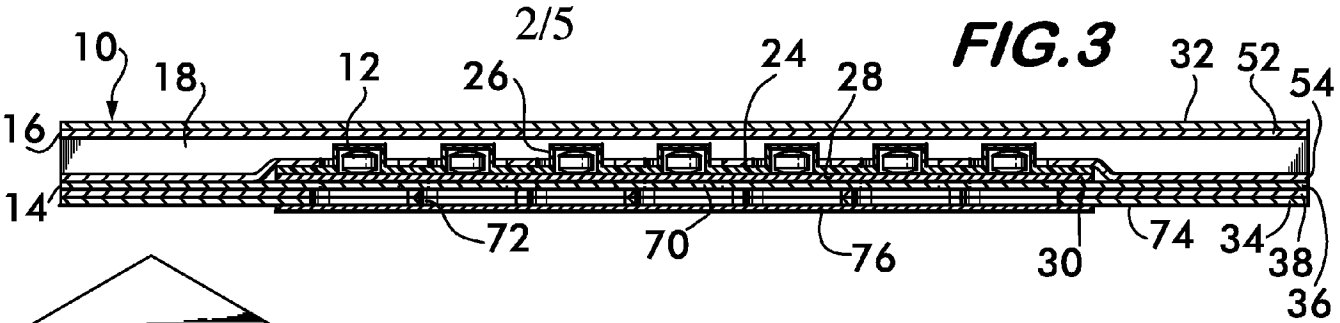
FIG. 3 is a cross-sectional view of the assembly taken along line 3-3 of FIG. 1.

As best shown in FIG. 4 with respect to the first card 20 and FIG. 7 with respect to the second card 22, some of the panels include either cut-out openings or perforations defining punch outs. For example, the panel 54 of the second card 22 includes a series of openings 66 which register and are aligned to receive the upstanding blister compartments 26 of the blister card 24. Thus as best shown in FIGS. 1 and 2, the blister compartments 26 extend through the openings 66 and project above the plane defined by the panel 54 of the second card 22.

The panel 36 of the first card 20 includes perforations 68 with define a series of small panels, or punch outs, 70. As best shown in FIG. 7, the panel 36 directly engages the underside, or backing layer, 30 of the blister card 24, and the punch outs 70 are at least somewhat aligned behind the blister compartments 36. Thus, until a sufficient amount of pressure is applied to a tablet 12 to break the perforations 68 of the a punch out 70, the tablet 12 cannot be removed from the package 10.

The panels 34 and 38 are located on an opposite side of panel 36 relative to the blister card 24. These panels, 34 and 38, each include a series of openings 72 that are aligned with each other and at least somewhat behind the blister compartments 26. Thus, for a tablet 12 to be dispensed from the package 10, it must pass through the rupturable backing layer 30 of the blister card 24, the punch out sections 70 of panel 36, and the openings 72 of panels 34 and 38. The punch outs 70 and openings 72 define the path through which of the tablets 12 are required to take to be dispensed from the package 10.

As best illustrated in FIG. 4, preferably the perforations 68 or peripheral edges of the punch outs 70 of the panel 36 do not exactly correspond with the openings 72 in the panels 34 and 38. For example, the size of the punch outs 70 relative to size of the openings 72 can be different, the shape of the punch outs 70 relative to the shape of the openings 72 can be different, and/or the punch outs 70 can be offset relative to the openings 72. The purpose of the above arrangement is to adjust the resistance required to be overcome for a tablet 12 to be dispensed from the package 10. For example, when the perforations 68 do not exactly align with the edges of the openings 72, a greater amount of force will typically be required to break the perforations 68. In the illustrated example, the punch outs 70 are oval in plan and the openings 72 are circular in plan. Thus, the ends of the oval punch out 70 extend beyond the boundary of the circular opening 72, while the elongate flattened sides of the oval 70 cut across, or dissect, the circular shaped opening 72. By way of example, the package 10 can be designed, for instance, to require a force of at least about 8 to about 12 pounds of pressure to be exerted on the blister compartment 26 and/or tablet 12 for the tablet 12 to be dispensed from the package 10.

Another aspect of the package 10 is that the blister card 24 is relatively centered on the flap 14 such it is framed within a relatively wide margin 74 where panel 36 of the first card 20 directly engages and is adhesively bonded to the panel 54 of the second card 22. In the margin 74, the flap 14 is four layers thick. Thus, the margin section 74 of the package 10 is not readily torn by a child and cannot be readily bitten or chewed through to access the tablets 12. Further, the four layers are adhesively bonded together and do not provide any section of the package 10 that can readily be pried apart by a child. These features along with the amount of force required to dispense a tablet 12 enable the package 10 to provide desired levels of child resistance.

When the package 10 is initially distributed to the end user, it can include a peel-away tamper indicating sheet 76 or the like. See FIG. 8. This removable sheet or sticker 76 initially covers the openings 72 that would otherwise be visually perceptible on the underside of the package 10. If the sheet 76 is completely or partially removed, this may indicate a used package or a package that may have been subject to tampering. If the sheet 76 is properly secured to the package 10, the end user must first remove this sheet 76 before dispensing tablets 12 from the package 10. Indicia, instructions, or other information (not shown) may be printed or applied on various external surfaces of the package 10.

Turning to the method of assembling the package 10, the first card 20 is preferably provided in blank form, for instance as illustrated in FIG. 4. Operations forming cut outs, perforations, and fold lines can be preformed on the blank and/or during manufacture of the blank. In addition, a heat or pressure sensitive adhesive may by applied to one side of the blank before or during its manufacture. Further, printing or separately applied labels can be provided on the blank during or after its manufacture. Thereafter, the convolute folds (discussed above) can be provided to the blank to produce a flap 14 with at least three layers, and heat and/or pressure can be applied to bond the at least three layer structure together.

After the at least three layer structure is formed, the blister card 24 can be aligned between the first and second cards, 20 and 22, and pressure and/or heat can be applied to the cards, 20 and 22, to adhesively bond the first and second cards, 20 and 22, together with the blister card 24 captured therebetween. The arrangement of the punch outs 70 and openings 66 and 72 can be provided as discussed above. A tamper-indicating release sheet 76 can be applied over the openings 72 that would otherwise be exposed on an underside of the package 10, and the flaps, 14 and 16, of the package can be positioned and/or secured in the closed book condition (see FIG. 2).

Various modifications to the package and its method of assembly can be used. For instance, the number of panels can be increased, and the shape, size and/or pattern of the perforations and openings can be changed. Further, different types of adhesives and other means can be used to bond the panels of the carded package together.

While preferred packages and methods of assembly have been described in detail, various modifications, alterations, and changes may be made without departing from the spirit and scope of the package and method according to the present invention as defined in the appended claims.

The invention claimed is:

1. A child-resistant package for containing tablets, comprising:

a carded package assembly having at least one flap carrying the tablets, said carded package assembly including a first card bonded to a separate second card with a blister card captured therebetween;

said blister card having a plurality of separate upstanding blister compartments in which the tablets are separately contained;

said first card having a flap including at least three panels folded together in a convolute spiral, wound or rolled configuration, each of said at least three panels including cut out openings or perforations defining punch outs;

said second card having a flap having cut out openings;

said blister card being sandwiched between said flap of at least three panels of said first card and said flap of said second card having openings such that said blister compartments project through said openings of said second card and said cut out openings and punch outs of said first card are located behind said blister compartments and define paths through which the tablets are dispensed from the package; and each of said first and second cards being made of SBS (solid bleached sulfate) paperboard having one side thereof coated with a heat and/or pressure activated adhesive.

2. A child-resistant package according to claim 1, wherein two of said panels of said at least three panel flap include a series of said cut out openings, and one of said panels of said at least three panel flap includes perforations defining a series of said punch outs.

3. A child-resistant package according to claim 2, wherein said series of said punch outs differ in at least one of size and shape with said series of said cut out openings of said first card.

4. A child-resistant package according to claim 3, wherein said panel with said punch outs confronts a backing layer of said blister card and is sandwiched between said blister card and said panels of said first card having cut out openings.

5. A child-resistant package according to claim 4, wherein said cut out openings of said first card are circular and said punch outs are oval such that the difference in said size and shape of said series of said punch outs and said series of said cut out openings of said first card cause a force of between about 8 to about 12 pounds to be required to dispense a tablet from the carded package assembly.

6. A child-resistant package according to claim 4, wherein said first card includes at least four panels in blank form with at least three of said panels being folded and adhesively bonded together in a convolute three-layer configuration to form said at least three panel flap of said first card.

7. A child-resistant package according to claim 4, further comprising a tamper-indicating release sheet bonded to an exterior of said carded package assembly and covering said cut out openings and said paths through which the tablets are dispensed from the carded package assembly.

8. A child-resistant package for containing tablets, comprising:

a carded package assembly having an integral pair of opposed flaps, one of said flaps carrying the tablets and the other of said flaps being a booklet-style cover foldable between a position covering the tablets and a position exposing the tablets, said carded package assembly consisting of a first card bonded to a separate second card with a blister card captured therebetween;

said blister card having a plurality of separate upstanding blister compartments in which the tablets are separately contained and secured via a rupturable backing layer;

said first card having a flap forming part of said booklet style cover and a flap including three panels folded together in a convolute spiral, wound or rolled three-layer configuration, two of said panels of said at least three panel flap including a series of said cut out openings, one of said panels of said at least three panel flap including perforations defining a series of said punch outs, and said series of said punch outs differ in at least one of size and shape with said series of said cut out openings of said first card;

said second card having a flap forming part of the booklet style cover and a flap having cut out openings;

said blister card being sandwiched between said flap of at least three panels of said first card and said flap of said second card having openings such that said blister compartments project through said openings of said second card and said cut out openings and punch outs of said first card are located behind said blister compartments and define paths through which the tablets are dispensed from the package; and each of said first and second cards being made of SBS (solid bleached sulfate) paperboard having one side thereof coated with a heat and/or pressure activated adhesive.

9. A child-resistant package according to claim 8, wherein said panel with said punch outs confronts said backing layer of said blister card and is sandwiched between said blister card and said panels of said first card having cut out openings.

10. A child-resistant package according to claim 9, wherein said cut out openings of said first card are circular and said punch outs are oval such that the difference in said size and shape of said series of said punch outs and said series of said cut out openings of said first card cause a force of between about 8 to about 12 pounds to be required to dispense a tablet from the carded package assembly.

11. A child-resistant package according to claim 8, further comprising a tamper-indicating release sheet bonded to an exterior of said carded package assembly and covering said cut out openings and said paths through which the tablets are dispensed from the carded package assembly.

12. A child-resistant package for containing tablets, comprising:

a carded package assembly having at least one flap carrying the tablets, said carded package assembly including a first card bonded to a separate second card with a blister card captured therebetween; and a tamper-indicating release sheet bonded to an exterior of said carded package assembly;

said blister card having a plurality of separate upstanding blister compartments in which the tablets are separately contained;

said first card having a flap including at least three panels folded together in a convolute configuration, each of said at least three panels including cut out openings or perforations defining punch outs;

said second card having a flap having cut out openings;

said blister card being sandwiched between said flap of at least three panels of said first card and said flap of said second card having openings such that said blister compartments project through said openings of said second card and said cut out openings and punch outs of said first card are located behind said blister compartments and define paths through which the tablets are dispensed from the package; and said tamper-indicating release sheet covering said cut out openings and said paths through which the tablets are dispensed from the carded package assembly.

* * * * *